US005706521A

United States Patent [19]

Haney

[11] Patent Number: 5,706,521

[45] Date of Patent: Jan. 13, 1998

[54] SPORTS GLOVE

[76] Inventor: Lee Haney, 105 Trail Point Cir., Fairburn, Ga. 30213

[21] Appl. No.: 594,350

[22] Filed: Jan. 30, 1996

[51] Int. Cl.[6] ..... A41D 19/00

[52] U.S. Cl. ..... 2/160; 2/161.1; 2/917

[58] Field of Search ..... 2/20, 19, 159, 2/160, 161.1, 161.6, 162, 167, 901, 910, 917

[56] References Cited

U.S. PATENT DOCUMENTS

| | | | |
|---|---|---|---|
| D. 320,872 | 10/1991 | McCrane | D29/22 |
| 482,647 | 9/1892 | Obear | 2/161.1 |
| 1,426,797 | 8/1922 | Wangelin | 2/160 |
| 3,421,160 | 1/1969 | Domenico | 2/161.1 |
| 4,042,975 | 8/1977 | Elliott, Jr. et al. | 2/161.1 |
| 4,411,024 | 10/1983 | Hayes | 2/161.1 |
| 4,793,005 | 12/1988 | Hetzel, Jr. | 2/161.1 |
| 4,843,651 | 7/1989 | Gramza et al. | 2/161.1 |
| 4,843,652 | 7/1989 | Kuwahara | 2/159 |
| 4,850,052 | 7/1989 | Matthews | 2/160 |
| 4,958,384 | 9/1990 | McCrane | 2/162 |
| 5,003,637 | 4/1991 | Lonon | 2/160 |
| 5,378,529 | 1/1995 | Bourdeau | 2/159 |

FOREIGN PATENT DOCUMENTS

| | | | |
|---|---|---|---|
| 93/08709 | 5/1993 | WIPO | 2/160 |

*Primary Examiner*—Michael A. Neas
*Attorney, Agent, or Firm*—Kennedy, Davis & Kennedy

[57] ABSTRACT

An improved glove for use by persons engaged in sports and work activities the glove having a pair of first pads attached to a back portion, the first pads having surfaces of a first character, and a removable cushion made of an absorbent cloth and having a pair of second pads with surfaces of a second character for gripping detachable engagement with the first pads, whereby engagement of the cushion to the glove provides an absorbent cushion for wiping perspiration from a user wearing the gloves.

2 Claims, 4 Drawing Sheets

SPORTS GLOVE

TECHNICAL FIELD

The present invention relates to gloves worn on hands. More particularly, the present invention relates to gloves worn by persons engaged in sports or work activities that involve use of hands.

BACKGROUND OF THE INVENTION

Gloves are articles of clothing worn to protect the hands of persons during sports and work activities. Typically gloves have shaped panels that cover the back and the palm of the hand. The panels are joined along lateral sides and one end is open for insertion of a hand. Four tubular sleeves extend from a forward portion of the glove for receiving fingers of the hand. Another sleeve is off-set to one side for receiving the thumb of the hand. Gloves provide protection for the hand from extreme temperatures, from frictional forces while working or engaged in sports, and from possible injury to ligaments and muscles in the hands.

Some known gloves are specially adapted for use in sports activities. In some types of these gloves, the tubular sleeves for receiving the fingers terminate in an open end short of the end of the finger. A portion of the fingers beyond the distal knuckles extends outwardly of the tubular sleeves of the glove. Such types of gloves permit tactile contact by the user of the glove with articles during sports or working activities. One example of this type of sports glove is described in U.S. Pat. No. 4,958,384 to McCrane. The glove described in McCrane further has an inelastic wrist strap that wraps around the users wrist to secure the glove while also tightly binding the wrist against flexure to protect against hyperextension of the ligaments and tendons in the wrist.

While gloves have worked satisfactorily for their intended purpose, there are limitations which cause problems for the users. One problem is a build-up of perspiration from the hand within the enclosed glove. The use of the glove over time leads to a building up of sweat and dirt, and the glove may become sticky and difficult to remove. In some gloves, the insertion and removal of fingers is difficult, particularly those having extended tubular sleeves for receiving the fingers. Odors are also a problem. Further, the diameter of the finger receptacles or openings for receiving the fingers in low-to-medium cost gloves typically are formed in average sizes for accommodating a range of finger diameters. This is a drawback to satisfactory use of the glove. Preferably the diameters of the finger receptacles should comfortably fit the individual wearing the glove. Finger receptacles which do not closely engage the fingers may not provide adequate protection to the user.

As discussed above, the work or sports engaged by a person wearing a glove typically is strenuous, and leads to perspiration by the user. Often the user picks up a towel to dry the perspiration. The towels however may be difficult to pick up while wearing gloves. Persons engaged in sports activity also may wear cloth wristbands for wiping perspiration from the face. However, it is awkward when holding weights, sports equipment, or tools to position the wrist for wiping one's face with a wristband for removing perspiration. The wiping action occurs at or inwardly of the flexible wrist which may pivot awkwardly with the cantilevered hand holding a weight.

It is thus seen that a need exists for an improved glove for use in strenuous work or sports activities. It is to the provision of such that the present invention is primarily directed.

SUMMARY OF THE INVENTION

The present invention meets the need in the art by providing an improved glove for use by persons engaged in sports and work activities, comprising a covering for the hand having separate receptacles for each of the fingers and the thumb, the improvement comprising a removably attachable cushion made of an absorbent cloth and means associated with an outside back surface of the glove and with the cushion for matingly engaging the glove and the cushion, whereby engagement of the cushion to the glove provides an absorbent cushion for wiping perspiration from a user wearing the gloves. The means for engaging the glove and the cushion include pads of mating characters, snaps, and slits in the glove that receive edge portions of the cushion.

More particularly described, the glove comprises a covering for the hand having separate receptacles for each of the fingers and the thumb, the improvement comprising a pair of spaced-apart first pads attached to an outside surface of a back portion of the glove and each of the first pads having a surface of a first character, and a removable cushion made of an absorbent cloth and having a pair of second pads attached on one surface thereof, said second pads spaced-apart for alignment with said first pads and said second pads each having a surface of a second character for gripping detachable engagement with the first pads, whereby engagement of the cushion to the glove provides an absorbent cushion for wiping perspiration from a user wearing the gloves.

In a preferred embodiment, the glove for use by persons engaged in sports and work activities to protect the hands and wrists comprises a palm portion having an inner layer of a cloth material for intimate absorbent contact with a palm of a person's hand, an outer layer of a denser resilient material, and a padding material disposed therebetween. A sleeve extends outwardly from around an aperture defined by the palm portion adjacent one of the lateral edges for receiving therethrough a thumb of a user of the glove. Four loops extend outwardly from the inner layer for receiving fingers of a user's hand. The loops are defined by a first elastic band that is attached with five parallel spaced-apart seams to a forward portion of the palm portion. A second elastic band attached to lateral edges of the palm portion defines a back portion of the glove. A pair of spaced-apart first pads attach to an outside surface of the elastic band, and each pad has a surface of a first character. A removable cushion made of absorbent cloth has a pair of spaced-apart second pads attached on one surface. The second pads each having a surface of a second character for gripping detachable engagement with the first pads.

The glove is secured to the user's hand by engaging a first strap and a second strap together, which straps encircle the wrist of a user of the glove. The first strap comprises a first portion extending laterally from the palm portion on the lateral side having the aperture, an elastic band attached to a distal end of the first portion, and a terminal member attached to a distal end of the elastic band. A pad having a surface of a first character attaches to the terminal member. The second strap extends from the lateral edge opposite the aperture and has a length less than the overall length of the first strap. A pad having a surface of a second character attaches to the second strap. The first and second straps encircle the user's wrist in opposite directions and are secured together by mating engagement of the pads of the first and second characters on the straps.

DETAILED DESCRIPTION

Figure 1:
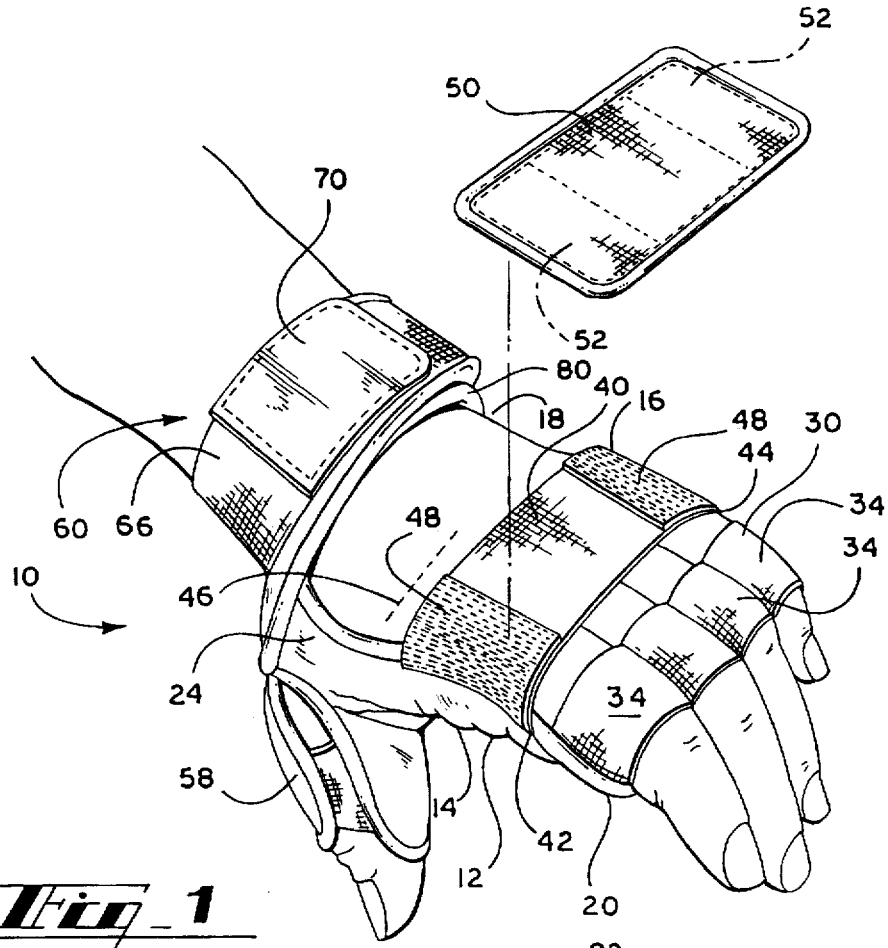
FIG. 1 is a perspective view of a sports glove according to one embodiment of the present invention.
Figure 2:
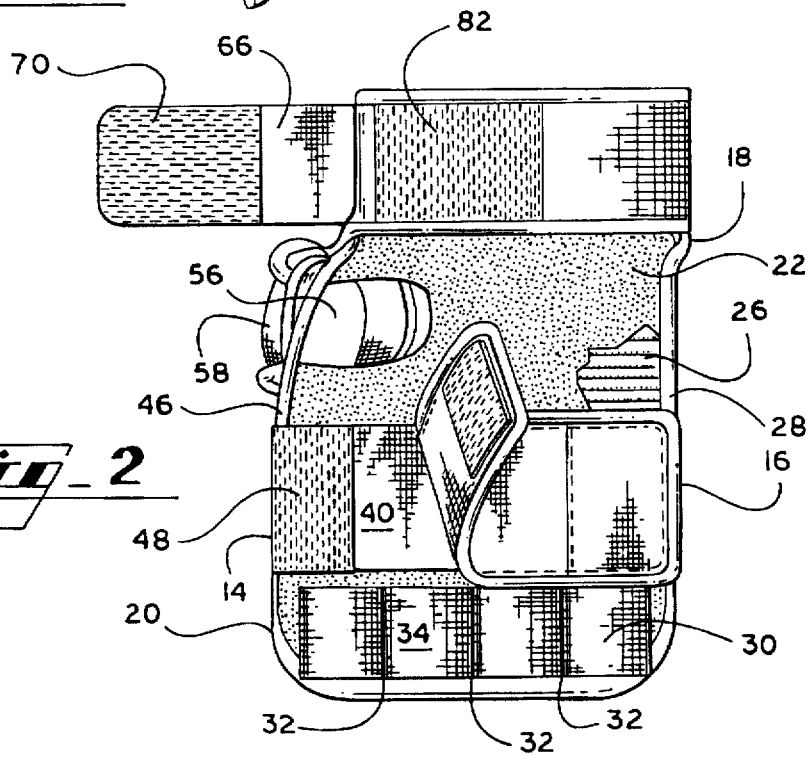
FIG. 2 is a bottom view of the glove of FIG. 1.
Figure 3:
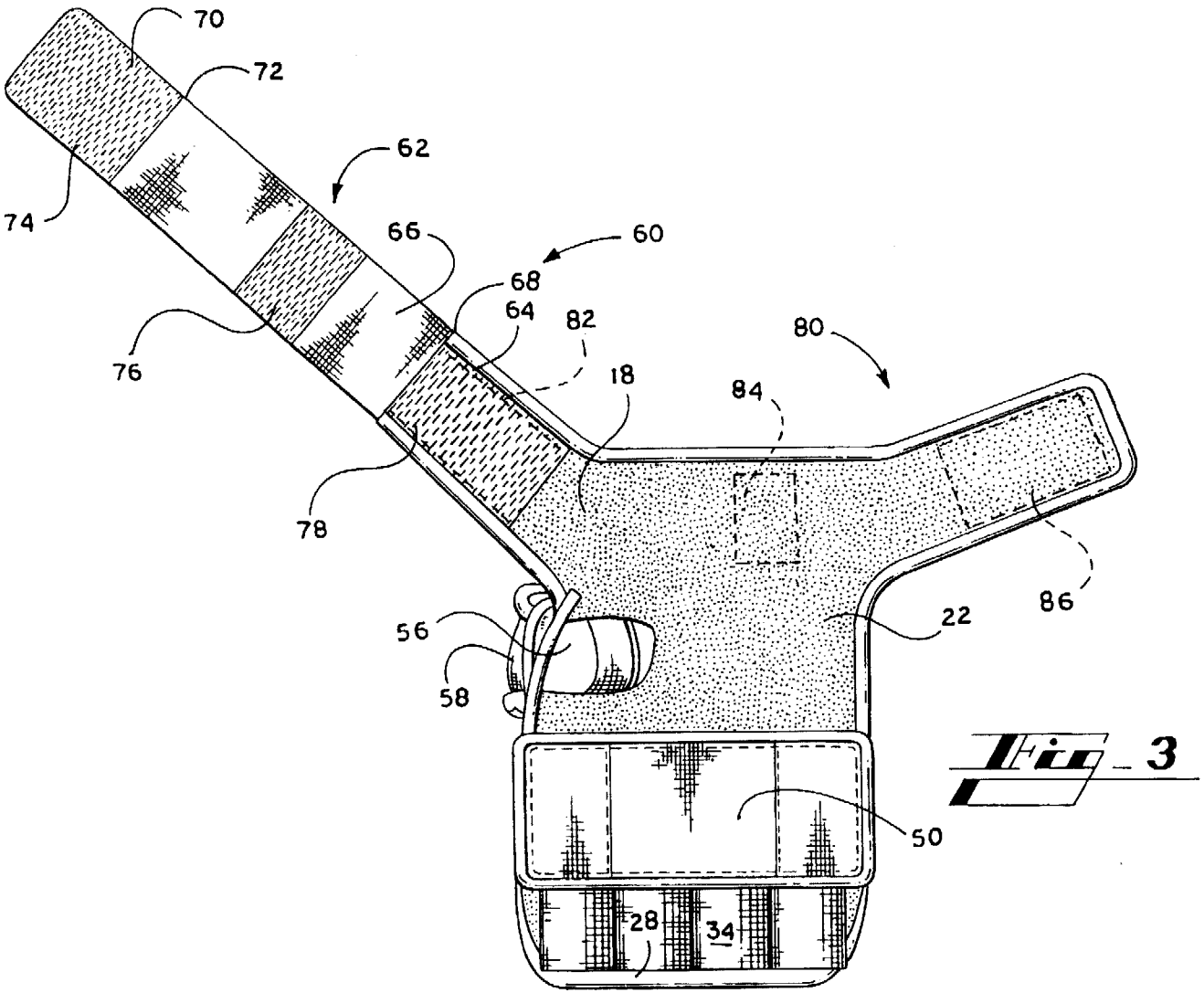
FIG. 3 is a bottom plan view of the glove illustrated in FIG. 1.

Referring now in more detail to the drawings in which like numerals identify like parts throughout the several views. FIGS. 1–3 illustrate a glove 10 according to the present invention for use in work or sports activities. The glove 10 has a palm portion 12 which covers the palm of a hand of the user between lateral sides 14 and 16 and from the wrist area 18 to a portion 20 forward of the knuckles. The palm portion 12 comprises a first inner layer 22 which is preferably made of a cloth material. The palm portion 12 has a second layer 24 which is formed of a denser and more resilient material. Padding 26 is preferably disposed between the inner layer 22 and the outer layer 24. An elongate flexible banding 28 is sewn around the perimeter of the palm portion 12 to secure the layers 22 and 24 together. Sewn seams (not illustrated) between the lateral sides define a padding pattern and facilitate joining the layers together. Preferably, the second layer 24 is made of an abrasion-resistant material such as split leather, or the like. The first layer 22 is preferably made of an absorbent cloth, such as terry cloth or the like.

An elastic band 30 is sewn along five transverse seams 32 to the forward portion 20 of the palm portion 12 of the glove 10. The band 30 is disposed so as to form a loop 34 between adjacent seams 32. Accordingly, the five seams 32 define four finger-receiving loops 34. The elasticity of the band 30 permits the loops 34 to flex open as fingers are inserted through the loops. The width of the band 30 can be wider for forming longer loops to cover more of the fingers. In alternate embodiments (not illustrated), fewer loops 34 are defined. For example, in one alternate embodiment, three transverse seams 32 define two finger loops 34. Two fingers are thereby held by the elastic band 30 and two fingers are free.

A back portion 40 is formed of an elongated strap that is attached by sewing longitudinal ends 42 and 44 to the respective lateral sides 14 and 16 of the palm portion 12. In the illustrated embodiment, the back portion 40 is an elastic band for releasably holding the glove 10 on the hand. In the illustrated embodiment, the back portion 40 covers a portion of the back of the hand from a transverse line near the approximate intersection of the thumb with the hand, generally designated 46, to forward of the knuckles. A pair of pads 48 are attached in spaced-apart relation to the back portion 40 adjacent the lateral sides 14 and 16. The pads 48 detachably engage a cushion 50 for purposes discussed below. The removably attachable cushion 50 is illustrated exploded from the glove in FIG. 1 and pulled partially away in FIG. 2. The cushion 50 is preferably made of an absorbent cloth material. A pair of spaced-apart pads 52 are attached to one surface of the cushion 50. The pads 48 and 52 are preferably made of hook-and-loop-type materials such as Velcro fastener, which grippingly engage together. In this manner, the cushion 50 is removably attached to the back portion 40. Accordingly, the pads 48 have a surface of a first character and the pads 52 have a surface of a second mating character for removable attachment of the cushion 50 to the glove.

The palm portion 12 further defines an aperture 56 on a lateral side 14 near the line 46. A tubular sleeve 58 extends laterally from the palm portion 12 around the aperture 56 for defining a receptacle for receiving a thumb of a user of the glove 10.

As best illustrated in plan view in FIG. 3, a wrist strap generally indicated 60 is provided for releasably securing the glove 10 to the hand by wrapping and securing the strap 60 around a wrist of the user. The wrist strap 60 has a first member 62 extending laterally from the wrist portion of the glove 10. The first member 62 includes a portion 64 that is integral with the wrist portion 18 of the glove 10, although the portion 64 can be a separate member attached by sewing to the wrist portion 18. An elastic band 66 attaches at one end 68 to the distal edge of the portion 64. The elastic band 66 preferably attaches by sewing along the seam 68. The elastic band 66 extends longitudinally for adjusting the overall length of the first member 62 between a first length and an extended second length. A terminal band 70 made of an inelastic material attaches to a distal end 72 of the elastic band 66, such as by sewing along a seam at 72. The first member 62 further includes three spaced-apart pads 74, 76, and 78 attached to a first surface of the first member. These pads 74, 76, and 78 are made of the mating hook-and-latch material. Each pad 74, 76, and 78 has a surface of a first character for mating engagement with pads of a second character, as discussed below for securing the strap 60 around the wrist of the user of the glove 10. The pad 74 is attached to the terminal band 70; the pad 76 is attached intermediate the ends 68 and 72 of the elastic band 66; and the pad 78 attaches to the portion 64 of the first member 62. The pads are preferably attached by sewing around a perimeter of the pads.

The wrist strap 60 further includes a second member 80 that extends from the distal lateral edge 16 of the glove. The second strap 80 is preferably integral with the wrist portion 18 of the glove 10 but may be a separate member that is sewn to the edge portion 16. Three spaced-apart pads 82, 84, and 86 are attached on the opposing face of the glove 10 on the outside surface of the second layer 24. The pads 82, 84, and 86 have a surface of a second character for mating engagement with the pads 74, 76, and 78 on the first member 62. The first member 62 and the second member 62 encircle the wrist of a user of the glove 10 and secure the glove to the user's hand by mating engagement of the pads 74, 76, and 78 with the pads 82, 84, and 86, respectively. The wrist strap 60, with its elastic band 66 has a length permitting the strap to encircle the user's wrist about two times.

In use, the glove 10 is slidingly received on the hand of a user, with the inner layer 22 of the palm portion 12 against the palm of the hand. The back portion 40 overlaps the back of the hand as the fingers extend into and through the respective loops 34. The elastic loops 34 flexingly receive the fingers passing therethrough. The glove 10 is pulled from the wrist portion 18 to seat the hand within the glove, with the back portion 40 covering the knuckles. The distal ends of the fingers extend outwardly of the loops 34. The thumb of the user's hand extends through the aperture 56 and into the protective sleeve 58.

The wrist strap 60 is then secured around the wrist of the user of the glove 10 to secure the glove to the hand. The second member 80 is looped from a lower surface of the wrist over the exterior face of the wrist towards the upper side of the wrist. The first member 62 similarly is looped from the lower surface of the wrist over the interior face of the wrist and overlapping the second member 80, whereby the pad 78 is matingly engaged with the pad 86. The terminal member 70 is grasped in order to pull on the first member 62. In response to the pulling force, the elastic band 66 elongates. The first member 62 is then wrapped over the wrist portion 18 of the glove 10, encircling the wrist and bringing the pads 76 and 84 into mating engagement. The encircling of the wrist by the first member 62 is continued in order to bring the pads 74 and 86 into mating engagement over the upper side of the wrist of the user. The glove 10 is thereby secured to the hand of the user by releasably engaging the wrist strap 60 around the wrist of the user. At least the mating pads 74 and 82 are used to secure the wrist strap 60, although the pads 78, 86, and 76, 84 provide intermediate securing of the wrist strap 60. The hand of the user is free to flex within the glove between the palm portion and the back portion. The fingers are exposed for tactile contact with articles.

The cushion 50 is attached by engaging the pads 52 on the cushion with the pads 48 on the back portion 40 of the glove 10. The cushion 50 provides a convenient absorbent pad for wiping perspiration from the face of the user wearing the glove. After use, the pads 50 are detached from the glove 10 and washed in a conventional washing machine. During work, sports, or exercise activities, dry cushions 52 may readily be substituted for cushions which become excessively moist from the perspiration of the user.

Figure 4:
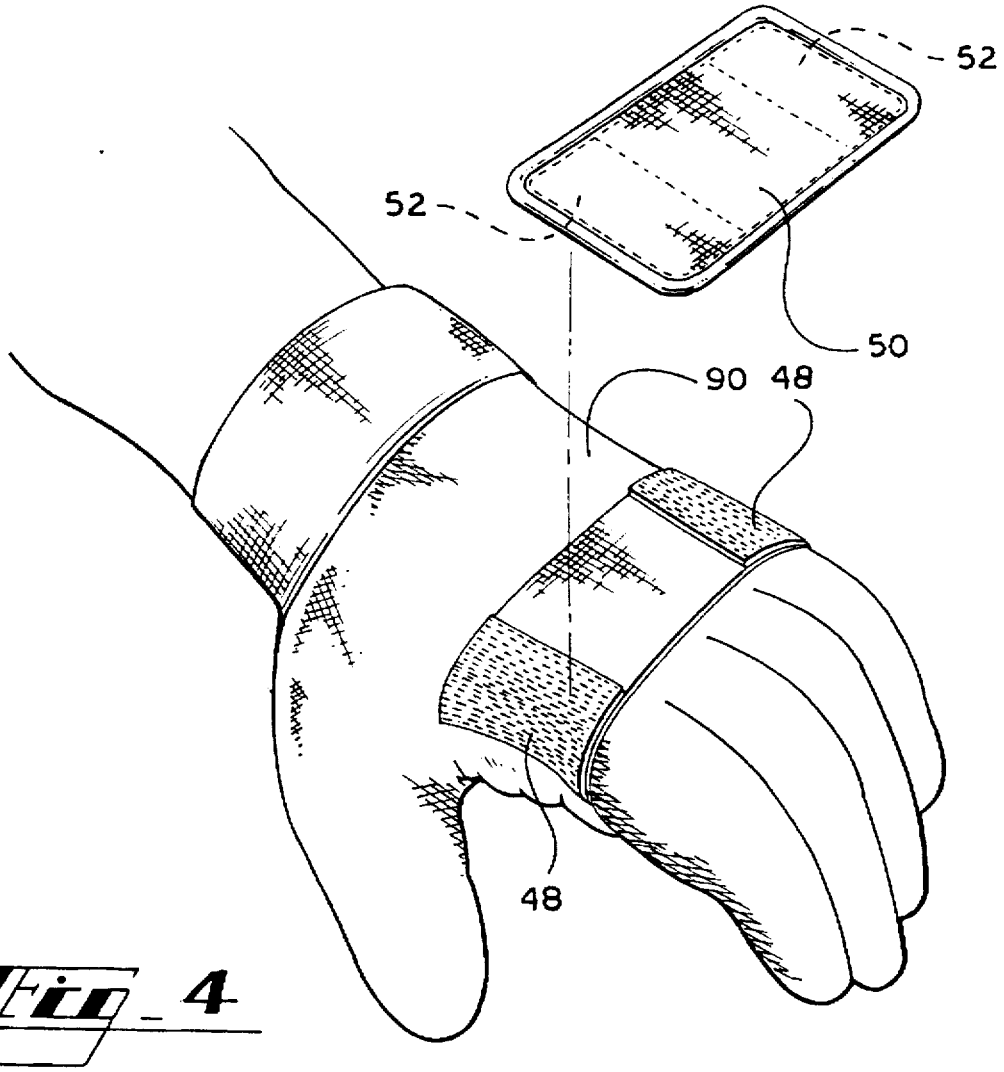
FIG. 4 is a perspective view of a glove according to the present invention.

As illustrated in FIG. 4, the detachable cushion 50 may gainfully be used with other conventional gloves, such as gloves for baseball, golf, tennis, and other such sports, as well as conventional work gloves for gardening, labor, driving and the like. A glove 90 provides a covering for the hand with separate tubular receptacles 92 for each of the fingers and the thumb. The pair of pads 48 are attached in spaced-apart relation to a back surface of the glove 90. The cushion 50 removably attaches by engaging the pads 52 with the pads 48. The cushion 50 is thereby readily available for use in wiping perspiration from the user of the gloves.

Figure 5:
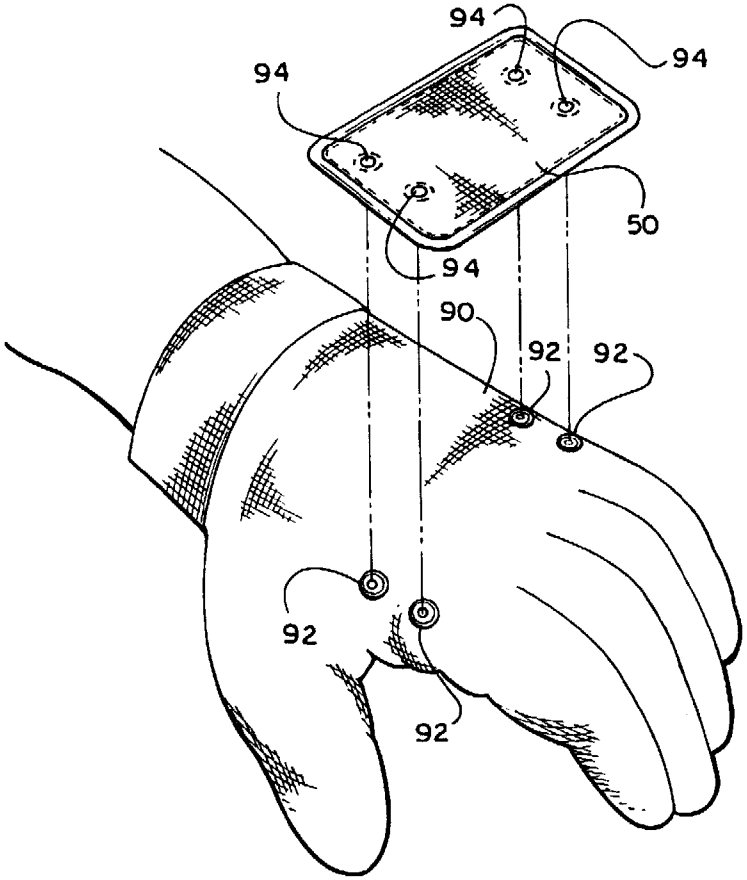
FIG. 5 is a perspective view of an alternate embodiment of the glove illustrated in FIG. 4.

FIG. 5 illustrates an alternate embodiment in which the pad 50 attaches with mating snaps 92, 94 that having male members 92 and female members 94 for detachably joining together to hold the pad to the glove. The members 92 and 94 have first and second characters, respectively that permit detachable connection together for securing the cushion 50 to the glove.

Figure 6:
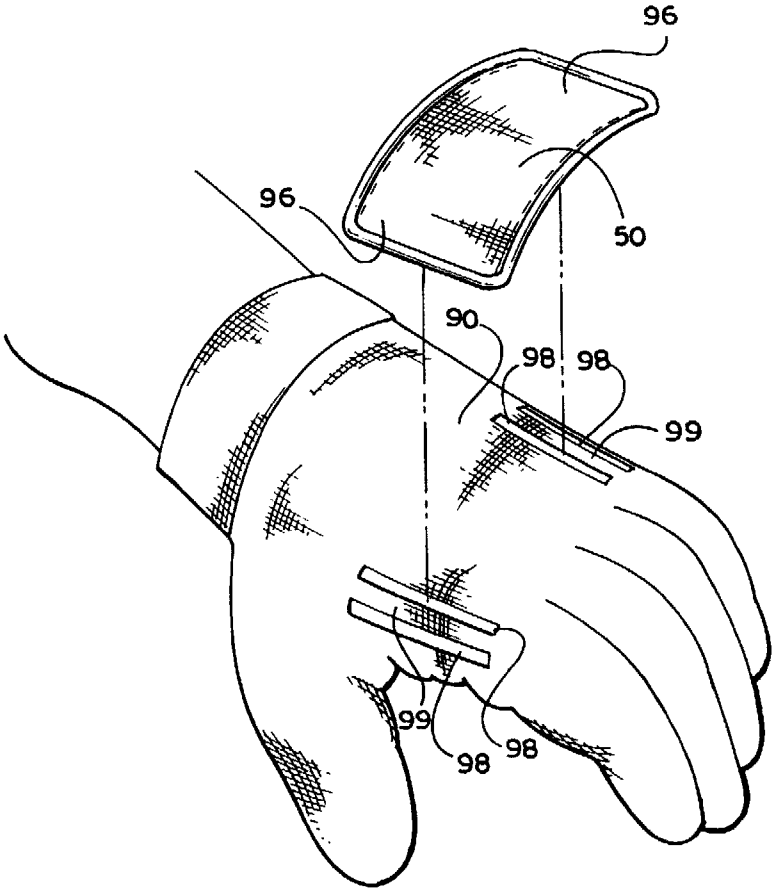
FIG. 6 is a perspective view of an alternate embodiment of the glove illustrated in FIG. 4.

FIG. 6 illustrates another alternate embodiment, in which the end portions 96 of the pad 50 insert into respective pairs of slits 98 in the glove for receiving and securing the pad to the glove. Each of the pairs of slits 98 define lands 99 therebetween. The respective end portions 96 insert into a first of each of the pair of slits 98, weave under the respective land 99, and out through a second of each of the pair of slits. The slits 98 and the edge portions of the cushion 50 define means having first and second characters for detachably engaging the cushion 50 to the glove. Thus, there is disclosed herein several means for attaching the pad 50 to the glove.

The foregoing has disclosed an improved sports glove for use in athletics and work activities. It should be understood that the above-described embodiments merely illustrate principles of the invention in preferred forms. Many modifications, additions, and deletions may, of course, be made thereto without departure from the spirit and scope of the invention as set forth in the following claims.

What is claimed is:

1. A glove for use by persons, being engaged in sports and work activities, to protect the hands and wrists, comprising:

a palm portion having an inner layer of a cloth material for intimate absorbent contact with a palm of a person's hand, an outer layer of a denser resilient material, a padding material disposed therebetween and a sleeve extending outwardly from around an aperture defined in the palm portion adjacent one of the lateral edges for receiving therethrough a thumb of a user of the glove;

a first elastic band attached with parallel spaced-apart seams to a forward portion of the palm portion to define finger-receiving loops extending outwardly from the inner layer;

a second elastic band attached to lateral edges of the palm portion to define a back portion;

a pair of spaced-apart first pads attached to an outside surface of the second elastic band and each of the pair of first pads having a surface of a first character;

a removable cushion made of absorbent cloth and having a pair of spaced-apart second pads attached on one surface, said second pads each having a surface of a second character for gripping detachable engagement with the first pads;

a first wrist strap comprising a first portion extending laterally from the palm portion on the lateral side having the aperture, a third elastic band attached to a distal end of the first portion, and a terminal member attached to a distal end of the third elastic band;

a third pad having a surface of a first character attached to the terminal member;

a second wrist strap extending from the lateral edge opposite the aperture; and a fourth pad having a surface of a second character attached to the second wrist strap, whereby the first and second wrist straps, being encircled in opposite directions around a wrist of a user of the glove, are secured together by mating engagement of the third and fourth pads thereon.

2. A glove for use by persons engaged in sports and work activities, comprising a covering for the hand having separate receptacles for each of the fingers and thumb, the improvement comprising a removably attachable cushion made of an absorbent cloth and means associated with an outside back surface of the glove and with the cushion for matingly engaging the glove and the cushion, said means comprising two pairs of spaced apart slits in the back surface of the glove, each pair of slits defining a land therebetween, and edge portions of the cushion, which being received and woven in the respective pairs of slits and lands, secures the cushion to the glove, whereby engagement of the cushion to the glove provides an absorbent cushion for wiping perspiration from a user wearing the gloves.

* * * * *